United States Patent [19]

Nelson et al.

[11] 4,370,104

[45] Jan. 25, 1983

[54] SUCTION MUFFLER FOR REFRIGERATION COMPRESSOR

[75] Inventors: Richard T. Nelson, Worthington; Marc G. Middleton, West Jefferson, both of Ohio

[73] Assignee: White Consolidated Industries, Inc., Cleveland, Ohio

[21] Appl. No.: 171,194

[22] Filed: Jul. 22, 1980

[51] Int. Cl.[3] ..... F04B 39/00

[52] U.S. Cl. ..... 417/312; 62/296; 181/403; 417/902

[58] Field of Search ..... 417/902, 312, 313, 363, 417/540, 542, 541-544; 181/403, 202, 230; 62/296, 503; 285/DIG. 22

[56] References Cited

U.S. PATENT DOCUMENTS

| | | | |
|---|---|---|---|
| 2,198,258 | 4/1940 | Money | 62/296 |
| 3,075,686 | 1/1963 | Steinhagen | 417/363 |
| 3,288,357 | 11/1966 | Comstock et al. | 417/902 X |
| 3,663,127 | 5/1972 | Cheers | 417/902 X |
| 3,689,203 | 9/1972 | Vaughn | 417/902 X |
| 3,817,661 | 6/1974 | Ingalls et al. | 417/312 |
| 4,084,844 | 4/1978 | Abner | 285/DIG. 22 |
| 4,239,461 | 12/1980 | Elson | 417/312 |

FOREIGN PATENT DOCUMENTS

| | | | |
|---|---|---|---|
| 52-28708 | 3/1977 | Japan | 417/312 |
| 1183881 | 3/1970 | United Kingdom | 285/DIG. 22 |

*Primary Examiner*—Robert E. Garrett
*Assistant Examiner*—Edward Look
*Attorney, Agent, or Firm*—Pearne, Gordon, Sessions, McCoy & Granger

[57] ABSTRACT

A hermetic refrigeration compressor includes a suction muffler formed from two pieces of plastic material mounted on the cylinder housing. One piece is cylindrical in shape with an end wall having an aperture for receiving a suction tube connected to the cylinder head. The other piece fits over and covers the other end of the cylindrical piece, and includes a flaring entrance horn which extends toward the return line on the sidewall of the compressor shell.

6 Claims, 5 Drawing Figures

FIG. 1
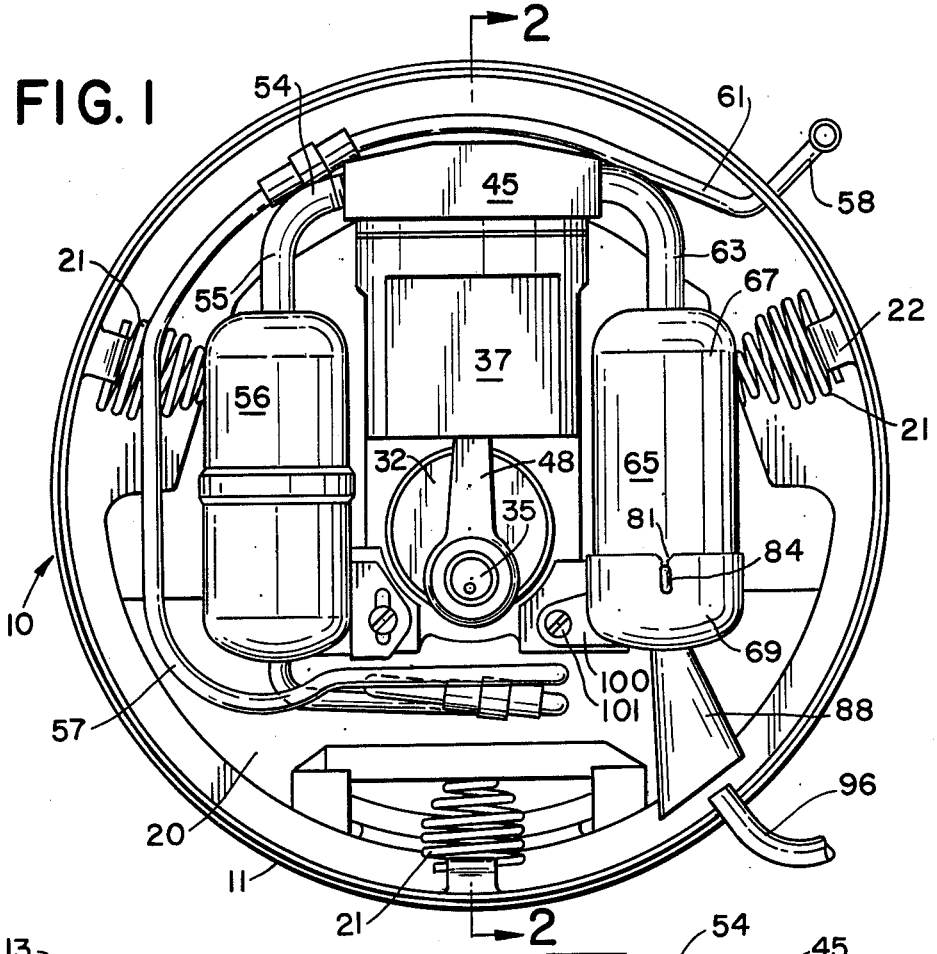
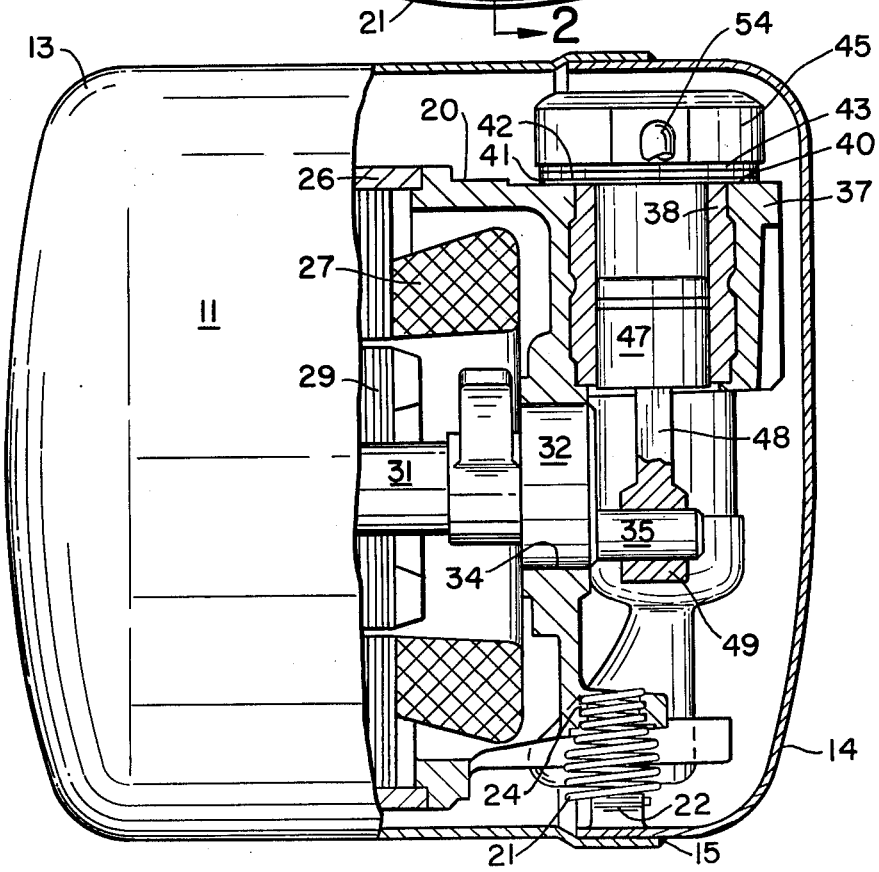
FIG. 2

SUCTION MUFFLER FOR REFRIGERATION COMPRESSOR

The Government has rights in this invention pursuant to Contract No. W-7405-ENG-26 awarded by the U.S. Dept. of Energy.

BACKGROUND OF THE INVENTION

This invention relates generally to hermetic refrigeration compressors, and more particularly to suction or inlet mufflers for refrigeration compressors of the type used in household appliances.

Refrigeration compressors are used in a large number of household appliances, such as refrigerators, freezers, dehumidifiers, and room air conditioners, and in these applications it is most important that the noise generated by operation of the compressor be held to a minimum practical level. Most of these compressors use a reciprocating piston operating at a relatively high speed, such as 3500 r.p.m., and this produces a relatively high frequency series of pulses for both the suction or inlet portion of the piston stroke and the discharge or outlet portion of the piston stroke. Because these pulsations naturally produce noise at audible frequencies, it has long been necessary to provide separate muffler arrangements at both the inlet and outlet of the compressor cylinder to dampen these pulsations and minimize the noise produced thereby. While such inlet and outlet mufflers are often made with a similar construction, it is recognized that the outlet or discharge muffler must necessarily be able to handle substantially higher internal pressures than the inlet muffler, and that the inlet muffler may therefore be made of a different or lower-cost construction to accomplish the same results.

Another matter that has become increasingly important in recent years is that the compressor be as efficient as possible with regard to the amount of cooling produced with respect to the amount of electrical energy input to the electric motor driving the compressor. It has been found that there are many ways in which compressor efficiency can be increased, including increasing the efficiency of the electrical motor driving the compressor, as well as decreasing the mechanical friction between the various moving parts. Other means for increasing overall efficiency include eliminating restrictions in the flow of the refrigerant gas through the compressor, as well as increasing the thermal efficiency. In many prior designs, the return refrigerant gas from the system evaporator was caused to circulate throughout the interior of the compressor shell to provide a cooling effect before the gas was fed into the inlet of the suction muffler. However, this cooling effect causes the refrigerant in the suction muffler to be heated, which reduces the thermal efficiency of the compressor.

SUMMARY OF THE INVENTION

The present invention provides a novel construction for the suction muffler of a hermetic refrigeration compressor in which the muffler is formed of a plastic insulating material, such as a polyester resin, which is compatible with the lubricating oil and refrigerant. In shape, the muffler is a hollow shell having generally longitudinally extending, cylindrical sidewalls with generally hemispherical ends, and is formed of two pieces joined together along a plane normal to the longitudinal axis of the cylinder, with one of the pieces telescoped within the other and further secured in a snap fit by locking detents. One piece carries the outlet opening centrally located in the one end and has a tubular projection extending into the interior of the muffler. A suction tube leading to the cylinder head of the compressor makes a slidable fit within this tubular projection so that the muffler can be anchored in a fixed position on the cylinder housing regardless of variations in the cylinder stroke, and hence deck height, of the compressor. With different sized compressors, the muffler can be mounted in the same location and the same cylinder head and suction tube be used, but with increasing deck heights for longer piston strokes, the suction tube will not project as far into the muffler.

At the other end, and on the other pieces of the suction muffler, there is a generally centrally located inlet opening with a tubular projection extending into the interior. On the outside is an outwardly flaring horn or bellmouth which is arranged to extend close to the wall of the compressor case so that the return line can be mounted at this place in the compressor case and extend in a direction directly into the horn or bellmouth. Thus, the return refrigerant immediately enters the interior of the muffler shell with a minimum of turbulence and minimum opportunity to absorb heat from the gas within the interior of the compressor casing. Furthermore, since the entire muffler shell is formed of an insulating material, it will limit heat transfer between the gas in the interior of the compressor shell and the gas within the interior of the muffler. By thus directly conducting the return refrigerant into the muffler and providing an insulating muffler, the return refrigerant undergoes a minimal amount of heating and can be brought into the compressor cylinder with a minimum rise in temperature, to provide a maximum volumetric efficiency for the compressor, and hence maximum overall energy efficiency.

BRIEF DESCRIPTION OF THE DRAWING

FIG. 1 is a top plan view of a hermetic refrigeration compressor, with the top cover member removed;

FIG. 2 is a partial, cross-sectional view of the upper portion of the refrigeration compressor, taken on line 2—2 of FIG. 1;

DESCRIPTION OF THE PREFERRED EMBODIMENT

Figure 3:
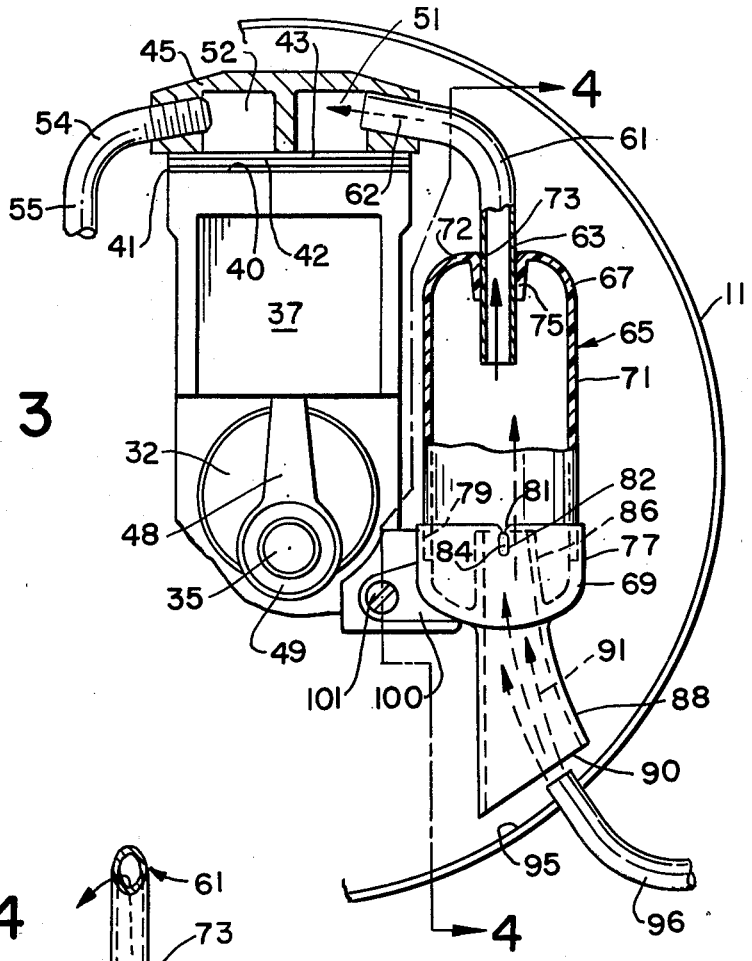
FIG. 3 is a fragmentary, cross-sectional view similar to FIG. 1 but showing the cylinder head and suction muffler in cross section.
Figure 4:
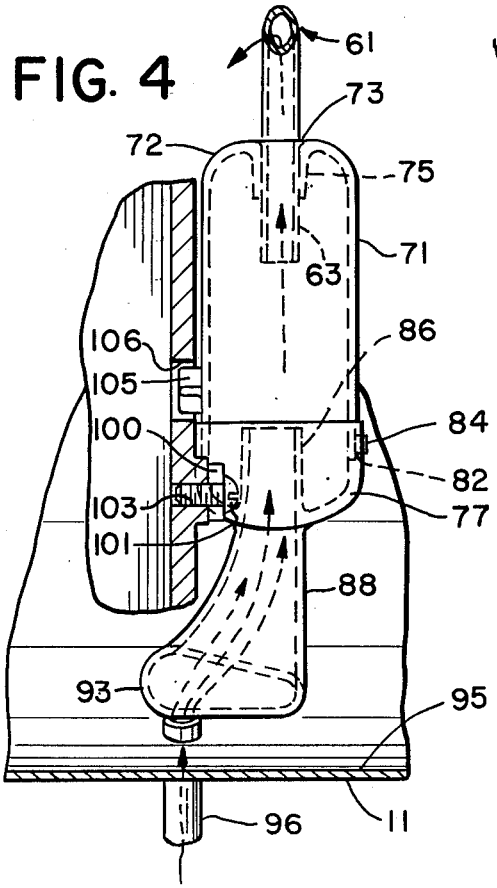
FIG. 4 is a fragmentary, cross-sectional view of the suction muffler taken on line 4—4 of FIG. 3.

Referring to the drawings in greater detail, FIGS. 1 and 2 show a hermetic sealed refrigeration compressor 10 having an outer shell or case 11 consisting of a cup-shaped lower section 13 and a cap-shaped upper section 14 which fit together and are sealed by a welded seam 15 to form a sealed unit.

The motor compressor unit within the case 11 includes a cylinder housing member 20 which is mounted within the case 11 by means of coil springs 21, which are secured to brackets 22 on the inside of the case 11 and are fitted within threaded sockets 24 on the cylinder housing 20. This allows the motor compressor unit to move within the housing to dampen vibrations and reduce the sound transmitted to the case 11.

On the lower portion of cylinder housing 20, and secured thereto, is a cylindrical stator housing 26 enclosing an electric motor stator 27, within which is mounted the rotor 29 secured to the crankshaft 31. Crankshaft 31 includes a journal portion 32 journaled within a bearing portion 34 on the cylinder housing 20, and the crankshaft 31 also includes a projecting crankpin 35. On one side of the bearing portion 34, the cylinder housing 20 includes an enlarged cylinder mounting portion 37 within which is fixedly secured a cylinder liner 38. On the side away from the crankshaft 31, the cylinder mounting portion 37 and liner 38 are machined to a flat deck surface 40 extending perpendicular to the axis of the cylinder liner 38. Next to the deck surface 40 is secured a first gasket 41 on the other side of which is mounted a valve plate 42 mounting the suction and exhaust valves for the compressor, which are usually in the form of lead valves but are not shown in greater detail because they form no part of the present invention. Outward of the valve plate 42 is another gasket 43 onto which is mounted the cylinder head 45. The two gaskets 41 and 43, as well as the valve plate 42 and the cylinder head 45, are all secured as a unit to the cylinder mounting portion 37 by suitable bolts (not shown) in the well-known manner. Within the cylinder liner 38 is carried the piston 47 connected by a wrist pin (not shown) to a connecting rod 48, which has a journal end 49 carried on the crankpin 35. Thus, as the crankshaft 31 rotates, the piston 47 will reciprocate within the cylinder liner 38 to and from the cylinder head 45.

The cylinder head 45 includes an inlet plenum chamber 51 and an outlet plenum chamber 52, each of which is connected to the interior of the cylinder liner 38 by a suitable valve on the valve plate 42. Connected to the outlet plenum 52 is a discharge tube 54 generally secured in place in the cylinder 45 by a suitable fastening means, such as brazing. The discharge tube 54 includes a bent portion 55 extending along the side of the cylinder housing 20 generally parallel with the axis of cylinder liner 38, and at its end is secured to a generally cylindrical discharge muffler 56. At the other end of discharge muffler 56 is connected the discharge line 57, which, after passing through several coils, extends around the outside of the cylinder block to connect to the exterior of the shell or case 11 at an outlet end 58.

In like manner, the inlet plenum 51 is connected to a suction tube 61, which is likewise secured in place in the cylinder head by suitable permanent fastening means, such as brazing, around the end portion 62, and the suction tube 61 includes a bent portion 63 extending along the other side of the cylinder mounting portion 37 generally parallel with the axis of the cylinder liner 38. A suction muffler 65 is fitted on the bent portion 63 of suction tube 61 in a manner to be described in greater detail hereinafter, and it is the suction muffler 65 which is the principal feature of the present invention.

The suction muffler 65 is in the general shape of an elongated cylinder with rounded end walls which have a basic exterior shape not much different from the discharge muffler 56. Suction muffler 65 consists of two members or pieces molded from an insulating plastic material, such as a polyester resin, which is compatible with, and will not deteriorate under prolonged exposure to, both the lubricating oil and the refrigerant within the compressor. The use of the insulating plastic material not only provides a thermal insulating factor to prevent the heat within the compressor housing on the exterior of the suction muffler from being conducted readily into the interior of the muffler, as would be the case if a metal shell were used, but also provides better sound dampening both because the material itself has better dampening qualities and because the walls can be formed of substantially thicker material than in the case of metal.

The muffler consists of an outlet member 67 and a separate inlet member 69 which fit together as described later. The outlet member 67 includes a generally cylindrical outer wall 71 which is closed at the one end by a generally hemispherical end wall 72 within which is located the outlet opening 73 generally coaxial with the axis of the outer wall 71. A tubular projection 75 extends within the muffler around the outlet opening 73, and this fits over the bent end of the suction tube 61. This fit can be a light push fit and the projecting end of the tubular projection 75 may be made with a very thin wall to make a nominal interference fit with the suction tube to serve as one of the means of holding the suction muffler in place. Because this is a suction muffler, it is not necessary that an absolute seal be maintained because whenever the compressor is running, the pressure within the interior of the suction muffler will be less than that in the surrounding shell.

Figure 5:
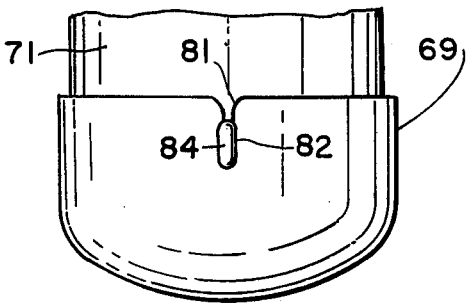
FIG. 5 is an enlarged, fragmentary plan view of the suction muffler showing details of the detent arrangement.

The inlet member 69 also has a cylindrical outer wall 77 of lesser axial extent than the outer wall 71 of the outlet member 67, and this is made to have a slightly larger outer diameter and greater wall thickness so that it may be provided with a counterbore 79 to receive the outer wall 71 of the outlet member 67 in a nested relationship, and its counterbore 79 has sufficient axial length so that when the outlet member is fitted within it, the alignment between the two suction muffler members is maintained with a high degree of accuracy. To further assist in holding the two members 67 and 69 together, the outer wall 77 at counterbore 79 is provided with an axial slot 81 (see FIG. 5) at at least one place on its periphery which includes an enlarged portion 82 of somewhat greater length and width. When the two muffler members are assembled together, the enlarged portion 82 is adapted to receive a projecting tab 84 on the outer wall 71 of the outlet member 67. The engagement between the tab 84 and enlarged slot portion 82 provides a detent action, tending to prevent axial separation of the two members, as well as providing for rotational alignment between the two members when they are assembled.

The inlet member 69 also has a generally hemispherical end wall 85 and there is a tubular projection 86 on the inside of this end wall extending generally along the cylindrical axis toward the other tubular projection 75 on the outlet member 67. On the outer side of end wall 85 is an outwardly flaring horn or bellmouth 88 which terminates on an outer end surface 90 that extends close to the inner wall 95 of the compressor shell or case 11. The horn 88 defines an inlet passage 91 extending through the tubular projection 86 into the interior of the muffler and is generally in alignment with the refrigerant return line 96, which is secured to the wall of the shell or compressor in general alignment with the center of the horn 88. It should be noted that the bottom portion 93 of the horn 88 flares sharply downwardly, and this is designed to allow oil passing through the system to drip off the horn into the bottom of the compressor shell and not pass through into the interior of the muffler.

In order to mount the suction muffler 65 on the compressor, the inlet member 69 has a projecting tab 100 adapted to receive a screw 101 which engages a threaded bore 103 on the cylinder housing 20 to firmly hold the inlet member in position. Further positioning is accomplished by a projecting lug 105, which may be cruciform in cross section, which extends downwardly from the bottom of the outer wall 71 of outlet member 67 to fit within a recess 106 on the top wall of the cylinder housing 20. Because the two suction muffler halves are aligned by the tab 84 and enlarged slot 82, both projecting tab 100 and projecting lug 105 will be in proper alignment when the muffler is assembled on the compressor so that the lug 105 can be pressed into the recess 106 and the screw 101 then allowed to pass through the projecting tab 100 into the bore 103 to clamp the muffler in place.

With this arrangement, it can be seen that since the outer end 90 of horn 88 extends in close proximity to the inner wall 95 of compressor shell 11, the return refrigerant gas from the return line 96 is directed directly into the horn 88 and inlet passage 91 so that it passes into the interior of the suction muffler with a minimum of turbulence and a minimum of exposure to the other refrigerant gas within the compressor shell, which would be at an elevated temperature. Furthermore, because the entire suction muffler 65 is formed from an insulating material, there is a minimum of heat transfer from the outside to the inside, which ensures that the gases entering the inlet plenum 51 in cylinder head 45 will pass there with a minimum of restriction and turbulence and with a minimum of heat absorption from the surrounding structure, tending to maximize the volumetric efficiency of the compressor.

Another feature of this arrangement is that the same suction muffler and cylinder head assembly may be used with compressors of different sizes. It is customary that to change the displacement of a compressor, the bore is not changed, since this would necessitate changing the mass of the piston and require various changes in other parts of the compressor, including the crankshaft, for balancing purposes. Therefore, it is usual to make the displacement changes by changing the stroke of the piston 47, and when this is done, the distance between the deck surface 40 and the axis of the crankshaft 31 must be changed to compensate for the distance in stroke. Since the suction muffler 65 is fixedly mounted in one position on the cylinder housing 20, it can be seen that with the same suction muffler and the same cylinder head 45 and suction tube 61, an increase in the height of the deck surface 40 corresponding to an increase in the stroke of the piston means that the cylinder head 45 will be shifted closer to the shell or case of the compressor and that the suction tube 61 will enter or project into the interior of the suction muffler by a lesser distance. However, because the suction muffler is merely a light press foot fit over the suction tube, it is not necessary to make any adjustment prior to assembly, and when the compressor is assembled, the parts will naturally align themselves when the suction muffler is fastened in place and the axial positioning between the outlet member 67 and the suction tube 61 will, in effect, be automatically adjusted without further change.

Although a preferred embodiment of this invention has been shown and described, it should be understood that various modifications and rearrangements of parts may be resorted to without departing from the scope of the invention as defined in the claims.

What is claimed is:

1. In a hermetic refrigeration compressor comprising a case having discharge and return lines secured thereto, a motor compressor unit mounted inside said case and including a cylinder housing and a cylinder head secured to said cylinder housing, said cylinder head including an inlet port and a discharge port, discharge muffler means connecting said discharge port to said discharge line, and a suction muffler connected to said inlet port, the improvement comprising said suction muffler comprising an elongated hollow shell of plastic insulating material, said shell having a sidewall and a pair of end walls defining an enclosed chamber, one of said end walls having an outlet opening from said enclosed chamber, said one end wall having a tubular projection around said outlet opening and extending into said enclosed chamber, a suction tube fixedly secured to said cylinder head and extending through said outlet opening into said enclosed chamber and contacting said tubular projection with a sliding push fit, the other of said end walls having an inlet opening into said enclosed chamber, an outwardly flaring horn around said inlet opening extending adjacent said case at said return line so that refrigerant from said return line is directed into said horn and said enclosed chamber with a minimum of turbulence.

2. A hermetic refrigeration compressor as set forth in claim 1, wherein said muffler shell comprises two members joined together along said sidewall, one of said end walls being on one of said members and the other of said end walls being on the other of said members.

3. A hermetic refrigeration compressor as set forth in claim 2, wherein said sidewall is cylindrical and said shell members are secured together along a joint lying in a plane normal to the axis of said cylindrical sidewall.

4. A hermetic refrigeration compressor as set forth in claim 3, wherein one of said shell members has a counterbore receiving the other shell member to define said joint and detent means at said joint locking said two shell members together.

5. A hermetic refrigeration compressor as set forth in claim 1, wherein the outer end of said outwardly flaring horn defines an end surface substantially equidistant at all points from the inside wall of said compressor case.

6. A hermetic refrigeration compressor as set forth in claim 5, wherein said outwardly flaring horn flares sharply toward the bottom of the compressor to provide a drip path for oil in the returning refrigerant gases.

* * * * *